US008057238B2

(12) United States Patent
Li et al.

(10) Patent No.: US 8,057,238 B2
(45) Date of Patent: Nov. 15, 2011

(54) MAGNETICALLY ACTUATED VISUAL DISPLAY BOARD

(76) Inventors: Xingkang Li, Worcester, MA (US); Qiang Li, Toronto (CA); Xingjian Li, Anhui (CN)

( * ) Notice: Subject to any disclaimer, the term of this patent is extended or adjusted under 35 U.S.C. 154(b) by 316 days.

(21) Appl. No.: 12/583,205

(22) Filed: Aug. 17, 2009

(65) Prior Publication Data

US 2011/0039251 A1 Feb. 17, 2011

(51) Int. Cl.
*B43L 1/00* (2006.01)

(52) U.S. Cl. ..... 434/409

(58) Field of Classification Search ..... 434/160, 434/161, 190, 402, 409; 40/426, 449, 450, 40/600; 446/129, 131–135
See application file for complete search history.

(56) References Cited

U.S. PATENT DOCUMENTS

| | | | | | |
|---|---|---|---|---|---|
| 3,186,115 | A * | 6/1965 | Todt et al. | 40/449 |
| 3,426,453 | A * | 2/1969 | Dingwall et al. | 434/409 |
| 3,460,276 | A * | 8/1969 | Payne | 434/409 |
| 3,615,993 | A * | 10/1971 | French | 156/155 |
| 3,668,699 | A * | 6/1972 | Vogelgesang et al. | 340/815.62 |
| 3,724,110 | A * | 4/1973 | Meyerson | 40/449 |
| 3,825,927 | A * | 7/1974 | Passien | 340/815.53 |
| 3,988,845 | A * | 11/1976 | Boatman | 40/542 |
| 4,232,084 | A * | 11/1980 | Tate | 428/321.5 |
| 4,583,312 | A * | 4/1986 | King et al. | 40/621 |
| 4,674,982 | A * | 6/1987 | Mackey | 434/188 |
| 5,026,071 | A * | 6/1991 | Miraglia, Jr. | 273/272 |
| 5,057,363 | A * | 10/1991 | Nakanishi | 428/321.5 |
| 6,629,847 | B1 * | 10/2003 | Satoh | 434/409 |
| 6,733,298 | B2 * | 5/2004 | Chen | 434/409 |
| 6,932,613 | B2 * | 8/2005 | Olsen et al. | 434/409 |

* cited by examiner

*Primary Examiner* — Kurt Fernstrom

(57) ABSTRACT

A magnetically actuated visual display board comprises a grid array of open ended chambers. Display configurations in each chamber utilize a magnetically responsive sliding element to move a display loop to alternate between two different display surfaces to create a desired visual array. A magnetic rod passing a chamber moves the sliding element within the chamber.

11 Claims, 4 Drawing Sheets

MAGNETICALLY ACTUATED VISUAL DISPLAY BOARD

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to magnetically actuated visual display boards wherein magnetic attraction is used to form characters and then to erase said characters and particularly to a magnetically actuated visual display board comprising a large box containing a grid array of chambers, magnetic rods which slide inside the chambers, at least one display opening in each chamber, a band of paper surrounding each magnetic rod which is attached to the chamber floor on first end and attached to the magnetic rod on a second end, and at least two different color squares on the paper strip; when a wand-like magnetic writing stylus passes in front of the chamber containing a magnetic rod with the wrapped band of paper it pulls the magnetic rod forward to make one color square on the paper appear in the chamber opening to create an array of similar color squares to form alphanumeric characters, symbols, images, or any other desired visual array, and when the magnetic writing stylus passes in back of the chamber containing the wrapped magnetic rod or the magnetic writing stylus is turned around to reverse the polarity, the rod is pulled or pushed backward, respectively, to make a different color square on the paper appear in the front chamber opening to erase the array of similar color squares and make all the squares match the background color.

2. Description of Related Art Including Information Disclosed Under 37 CFR 1.97 and 1.98

Magnetic drawing or writing boards are popular with young children. These toys consist of a screen in a housing containing a magnetic material such as iron powder or a fluid with suspended magnetic particles. A stylus having a magnetic tip is drawn across the screen causing the magnetic powder or particles to be drawn up against the underside of the screen to draw figures or practice writing. It is possible that a child can break the housing, the fluid or powder can leak from the toy.

Most writing boards, such as chalkboards or whiteboards, require expendable writing elements (chalk and markers, respectively) which must be replaced. Both present problems with the chalk dust and marker colors rubbing off on hands and clothing. Further the dust from the chalkboard becoming airborne is a breathing hazard and prevents usage of chalkboards in rooms with computers or other electronic equipment. Prior art devices have not adequately solved the problem of providing a writing surface which is highly visible and reusable without the need for replaceable writing implements and is relatively inexpensive and usable in any location without the need for electric power or expensive circuitry.

U.S. Pat. No. 3,103,751, issued Sep. 17, 1963 to McDonald, claims a chalkless, magnetic type writing board. The writing board consists of a substantially rigid opaque sheet of material spaced from a backing sheet to define therebetween a chamber. The chamber confines a plurality of metallic pins slidably mounted in apertures located in the backing sheet. The pins are of a color contrasting the opaque sheet. Markings appear on the opaque sheet by drawing a magnetic stylus over the outer surface of the sheet, thereby attracting the pins to the interior surface of the sheet. Erasure is accomplished by passing a mechanical vibrator over the opaque sheet.

U.S. Pat. No. 6,092,294, issued Jul. 25, 2000 to Mak, describes a drawing board that has a body and a generally transparent screen on the body. The screen has front and rear sides and contains a viscous opaque liquid and iron dust in the liquid. A pen that has a magnetic tip is used to draw on the screen. A magnetic eraser is movable within the body between a rest position away from the rear side of the screen and an operating position against that rear side for operation to move, through magnetic attraction, the iron dust away from the front side of the screen such that the iron dust becomes invisible on the screen. A spring biases the eraser towards the rest position.

U.S. Pat. No. 3,426,453, issued Feb. 11, 1969 to Dingwall, describes a magnetic display device that has a multiplicity of magnetic cylinders. The magnetic cylinders have contrastingly colored end faces, disposed one each in cylindrical pockets formed in a laminar display board. The display board has a transparent cover and magnetized laminations, both of which rotate to selectively expose a contrasting surface to view when a magnetized writing stylus is moved over the display surface.

U.S. Pat. No. 3,518,664, issued Jun. 30, 1970 to Taylor, shows magnetically actuable pivotally mounted visual elements that have two alternative positions that are controlled in accord with the directions of two resultant exterior magnetic fields, which are alternatively applicable. Each resultant field results from the resolution of one sense of a reversible magnetic field and of a non-reversing bias field.

U.S. Pat. No. 3,724,110, issued Apr. 3, 1973 to Meyerson, shows a visual display device with a multi-apertured front side. The apertures are the forward ends of a plurality of passages in the visual display board in which a plurality of respective movable members cause a character to be displayed responsive to the positions of the movable members.

US Patent Application #20050079479, published Apr. 14, 2005 by Chen, indicates a container assembly including a container body, a magnetic display panel on the container body, a magnetic pen, and a magnetic eraser. The magnetic display panel is mounted on an outer wall surface of the container body, and has a rear side confronting the container body and an opposite front side. The magnetic display panel has a multi-cellular configuration, and includes a cell array and a dispersion contained in the cell array. The dispersion contains magnetic particles. The magnetic pen is used to move the magnetic particles in the cell array to the front side of the magnetic display panel so as to form an image thereat. The magnetic eraser is used to move the magnetic particles in the cell array to the rear side of the magnetic display panel so as to erase the image formed by the magnetic particles at the front side of the magnetic display panel.

U.S. Pat. No. 6,326,945, issued Dec. 4, 2001 to Williams, III, depicts a magnetic writing board that provides a thin, lightweight, durable writing board, which has an internal array of closely arranged magnet assemblies. The magnetic writing board is operated to contemporaneously create a display, which may be transferred to a computer for the modification thereof. The image may then be redisplayed, printed, stored, and/or remotely displayed such as at a computer monitor. A portion or all of an image may be completely and immediately erased. The magnetic writing board includes a grid disposed behind a display surface and a plurality of display elements, one each disposed within each cell defined by the grid. Each grid cell receives a masking agent to obscure the contrasting color of at least the forward edge of the display element when the display element is in the back position. The magnet assemblies are each oriented with their magnetic poles in the same direction, with the positive and negative poles being oriented to face either the front or back of the magnetic writing board. A writing and erasing implement includes a pair of oppositely disposed magnets, one being disposed at each end. The writing end of the implement has a magnetic pole opposite to the forward facing pole of the magnet assemblies, causing the magnet assemblies directly in front of the writing end of the implement to be attracted toward the display surface.

U.S. Pat. No. 5,478,084, issued Dec. 26, 1995 to Itkis, puts forth a magnetic bingo board that has a transparent bingo card, which overlays a magnetic indicator board. The bingo numbers on the card are marked with a magnetic wand that darkens the area of the magnetic indicator board immediately underneath the bingo number. All marks are erased at the start of new bingo game by an eraser magnet sliding inside of the indicator board. The indicator board incorporates a microprocessor that optically tracks all cards being played by reading data marks on the transparent bingo board.

U.S. Pat. No. 2,589,601, issued Mar. 18, 1952 to Burnett, is for a magnetic slate that has a transparent cover and a shallow box, which are sealed tightly against moisture. Located inside the box are small pellets made of magnetic material and overlying the magnetic material pellets is a layer of non-magnetic elements. The magnetic pellets may be raised with a magnetic stylus above the non-magnetic layer to form words. To erase the words or markings, the magnetic slate is held level and shaken, thereby causing the magnetic pellets to fall below the layer of non-magnetic material.

Two U.S. Pat. Nos. 3,982,334 issued Sep. 28, 1976 and 3,938,263 issued Feb. 17, 1976 to Tate, show a device adapted to provide a visual display under the influence of an exterior magnetic field, which comprises a plurality of rotatable, multi-colored, non-magnetically interactive, permanently magnetized micro magnets disposed in a cavity within a body. The body has a transparent surface and a plurality of relatively small compartments within the cavity. The device has a sheet containing micro magnets between the thin cavity of the front and rear surfaces of the sheet where the relatively even dispersion of the micro magnets in the sheet is maintained by such compartments whose barriers minimize displacement so that physical pressure exerted on the sheet, such as by a twist or flex, does not substantially alter the even dispersion of the micro magnets. In an embodiment, the visual display device is a sheet, preferably a substantially transparent or invisible polymer sheet, containing relatively small compartments therein which have cellular and/or structural barriers which prevent substantial displacement therefrom by holding in such compartments rotatable micro-magnets which are surrounded with a suspension or carrier fluid which allows such rotation. In the preferred embodiment the suspension or carrier fluid is thixotropic.

Two U.S. Pat. Nos. 5,101,587 issued Apr. 7, 1992 and 5,125,176 issued Jun. 30, 1992 to Toraby-Payhan, claim a numeral display device having at least one visible face. Each segment of the device has a transparent outer pane and a spaced, parallel inner pane forming a pocket, a first portion of the pocket being aligned with and visible through an opening in the face. A flexible film is received in each pocket. A mechanism is provided to insert and withdraw each film from the first portion of each pocket so that each segment will either contrast with or match the face. In an alternate embodiment the film has a front edge to which is affixed a metal strip so that movement of a magnet exterior to said face will cause said film to be slidably inserted or withdrawn from said first portion of said pocket.

What is needed is a safe magnetically actuated visual display surface which is highly visible and reusable without the need for replaceable writing implements and is relatively inexpensive and usable in any location without the need for electric power or expensive circuitry.

BRIEF SUMMARY OF THE INVENTION

An object of the present invention is to provide a display board comprising an array of boxes with openings on one or both sides each box containing a magnetic rod inside a tubular elongated sheet having at least two outside different patches of color to be alternately visible in one of the box openings or two sets of paired different color patches with one pair alternately visible on each side of the display board when the magnetic rod is pushed or pulled by a magnetic stylus with a different pole at each end to provide a safe magnetically actuated visual display surface which is highly visible and reusable without the need for replaceable writing implements and is relatively inexpensive and usable in any location without the need for electric power or expensive circuitry.

In brief, the present invention provides a magnetically actuated visual display board wherein magnetic attraction is used to form and erase characters. The magnetically actuated visual display board comprises a grid array of chambers with openings on one or both sides of the display board. Each chamber contains a magnetic rod inside a tubular elongated sheet, the sheet having at least two outside different patches of color to be alternately visible in one of the chamber openings or two sets of paired different color patches with one pair alternately visible on each side of the display board. The magnetic rod slides inside the chamber. The tubular elongated sheet, which may be a band of paper surrounds the magnetic rod. The sheet is attached to the chamber floor on first end and attached to the magnetic rod on a second end so that when a wand-like magnetic writing stylus passes in front of the chamber, it pulls the magnetic rod forward to make one color square on the paper appear in the chamber opening to create an array of similar color squares to form alphanumeric characters, symbols, images, or any other desired visual array of a different color than the background. When the magnetic writing stylus passes in back of the chamber containing the wrapped magnetic rod or the magnetic writing stylus is turned around to reverse the polarity, the rod is pulled or pushed backward, respectively, to make a different color square on the paper appear in the front chamber opening to erase the array of similar color squares and make all the squares match the background color.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
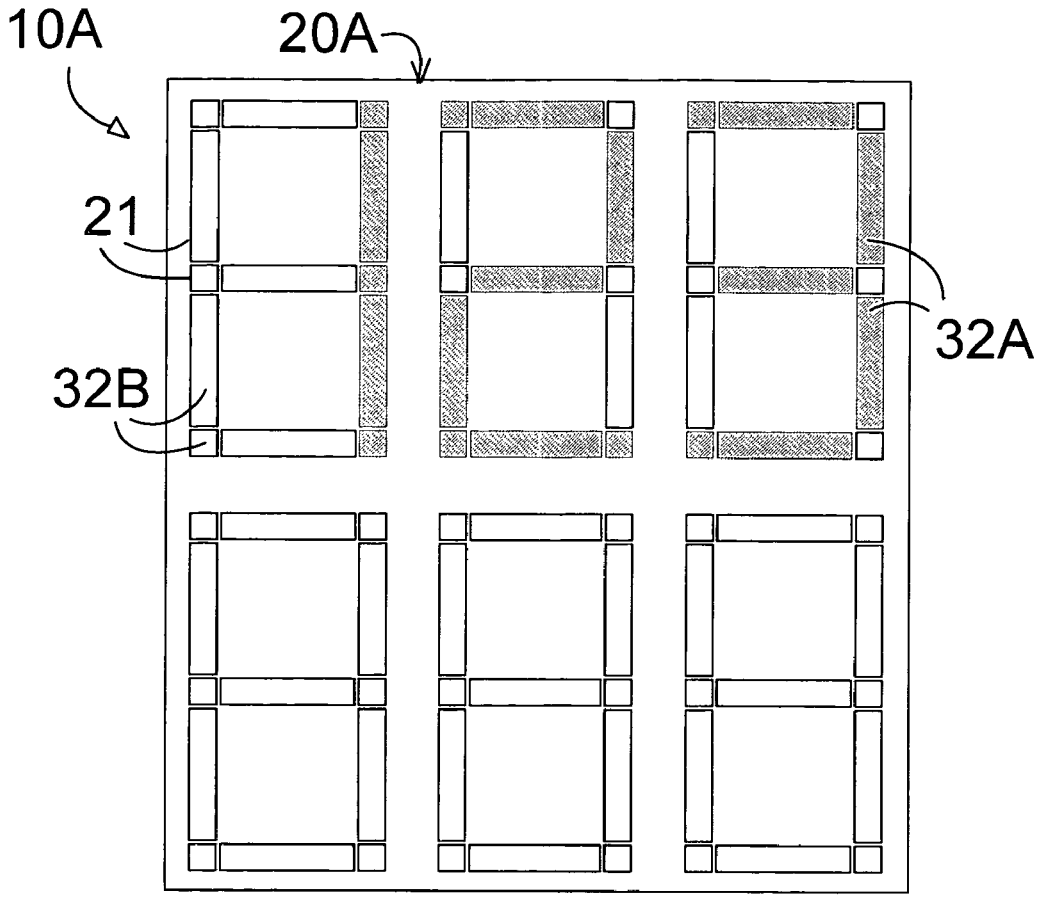
FIG. 1 is a schematic elevational view of a numerical display with each number formed by an array of thirteen active magnetic display units of different shapes and orientations.

In FIGS. 1-10, a magnetically actuated visual display board device 10 for using magnetic attraction to form and erase visual images comprises a visual display board 20A and 20B having a display grid array of chambers 21 containing display configurations 30 having display loops 31 having alternating display faces on visual display surfaces 32A and 32B pivoted alternately into place in front of the opening by sliding members 50 and 60 actuated by a magnetic stylus in the form of an elongated magnetic rod 40A and 40B.

Figure 2:
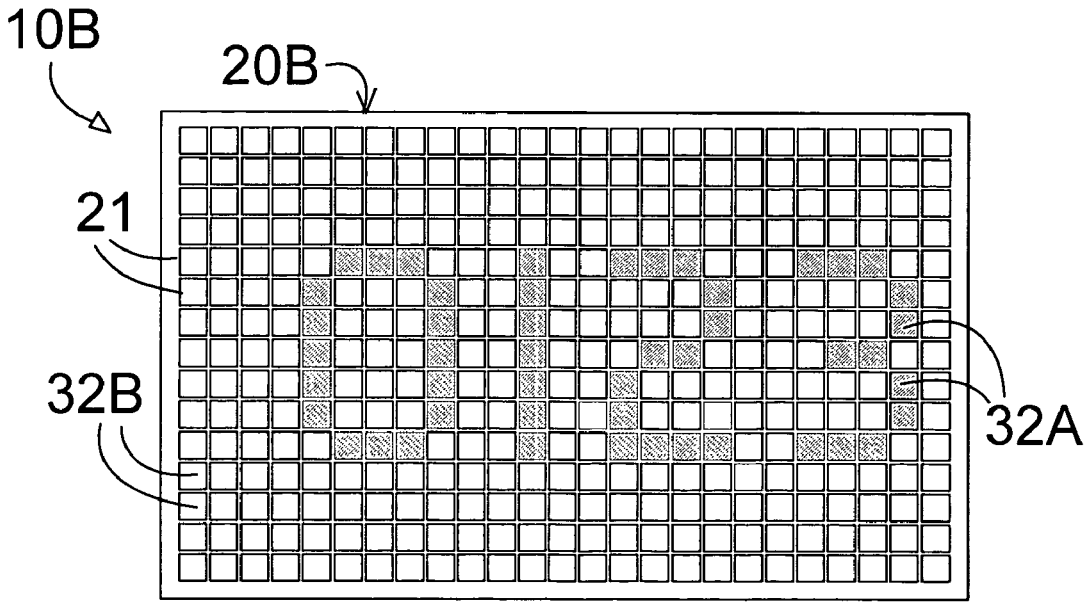
FIG. 2 is a schematic elevational view of a writing board for alphanumeric characters or any desired visual display composed of an array of passive magnetic display units.
Figure 3:
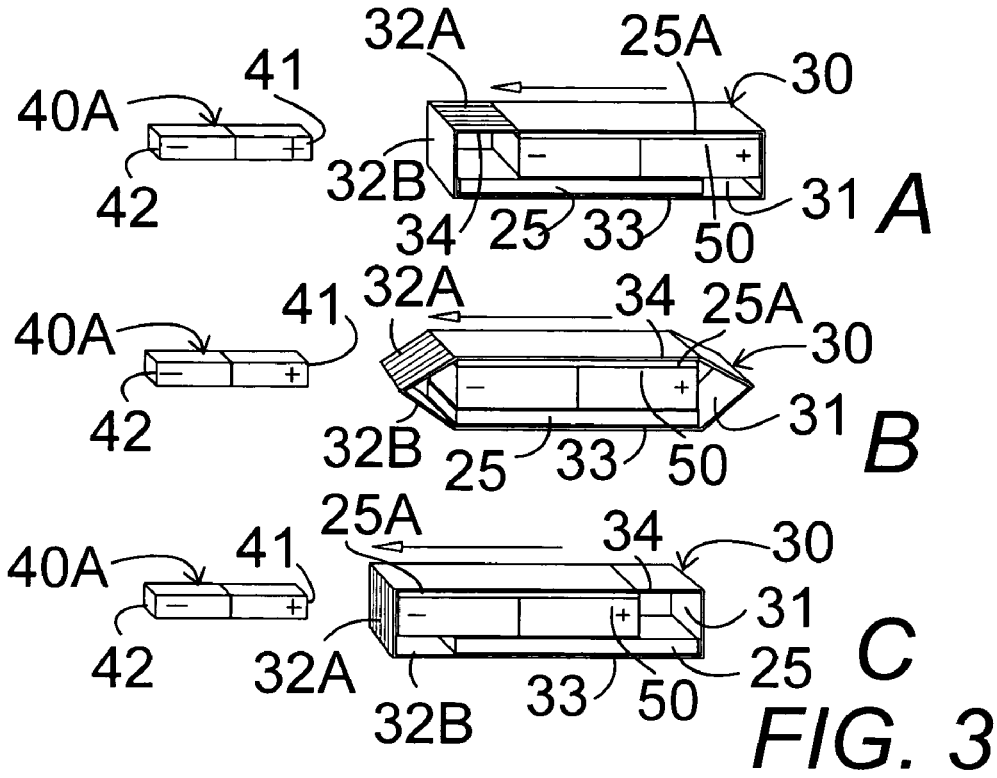
FIGS. 3A-3C are progressive schematic perspective views showing the display configuration within a chamber having a sliding member and display loop of the present invention with the magnetic sliding member moving toward an opening of the chamber switching the display face of the planar display loop in response to the magnet writing stylus in front of the opening having a positive magnetic end facing the negative magnetic end of the sliding member to create a portion of the visual image.
Figure 4:
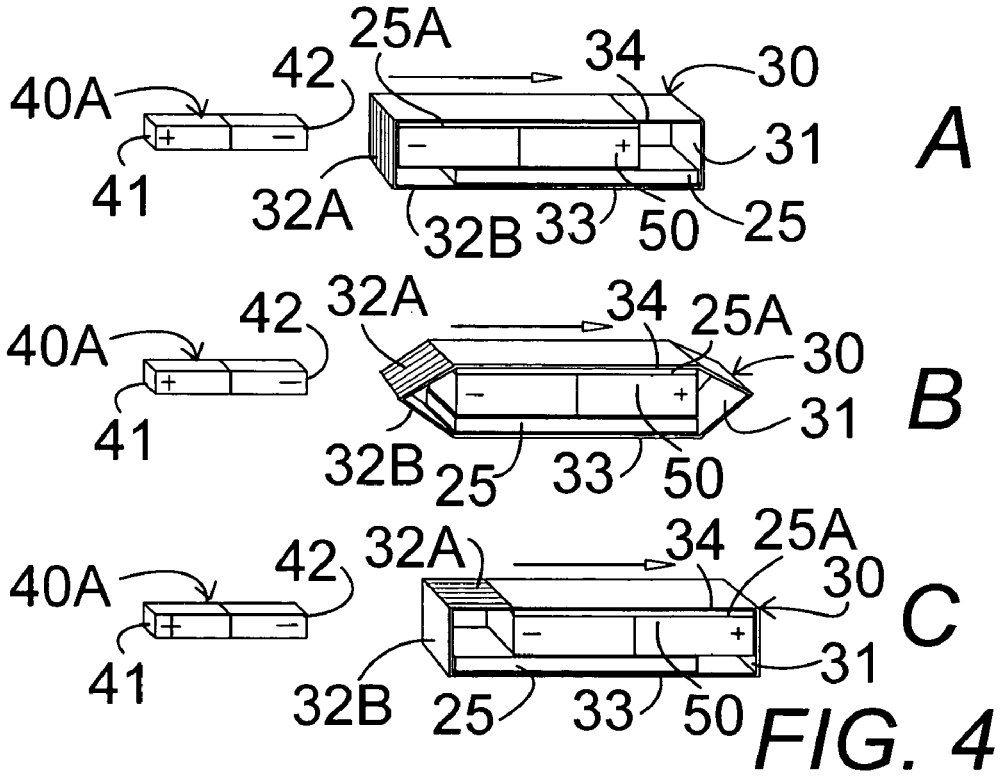
FIGS. 4A-4C are progressive schematic perspective views showing the display configuration with the sliding member and display loop of FIGS. 3A-3B with the magnetic sliding member moving away from an opening of the chamber switching the display face of the planar display loop in response to the magnet writing stylus in front of the opening having a positive magnetic end facing the negative magnetic end of the sliding member to erase the portion of the visual image.
Figure 5:
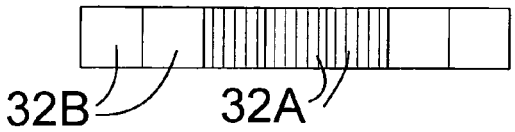
FIG. 5 is a front elevational view of a portion of a row of chambers of the face of the visual display showing the three center chambers having the sliding members pulled forward to display the contrasting display face of the display loop in contrast to the normally displayed display faces of the chambers on the sides.
Figure 6:
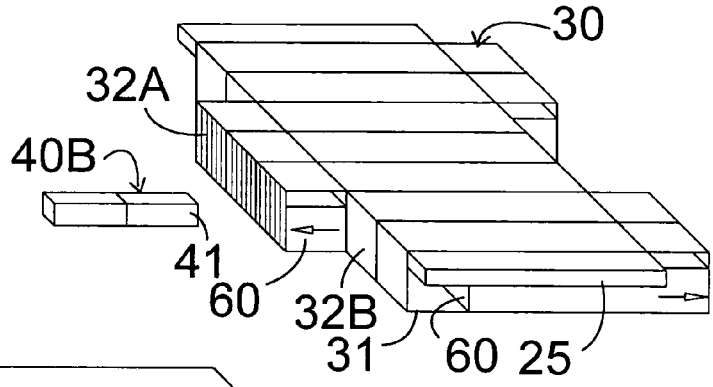
FIG. 6 is a schematic perspective view of the display configuration of a partial row of chambers of FIG. 5 showing the iron bar sliding member moving toward an opening of the chamber in the center three chambers switching the display face of the planar display loop in response to the magnet writing stylus in front of the chamber openings to create a portion of the visual image, wherein the display loop is attached to a top interior wall of the chamber and the sliding member slides adjacent to the bottom interior wall of the chamber.
Figure 7:
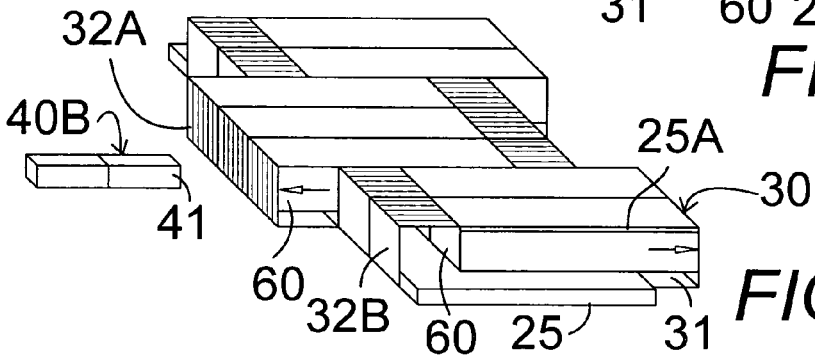
FIG. 7 is a schematic perspective view of the display configuration of the partial row of chambers of FIG. 5 showing the iron bar sliding member moving toward an opening of the chamber in the center three chambers switching the display face of the planar display loop in response to the magnet writing stylus in front of the chamber openings to create a portion of the visual image, wherein the display loop is attached to a bottom interior wall of the chamber and the sliding member slides adjacent to the top interior wall of the chamber.
Figure 9:
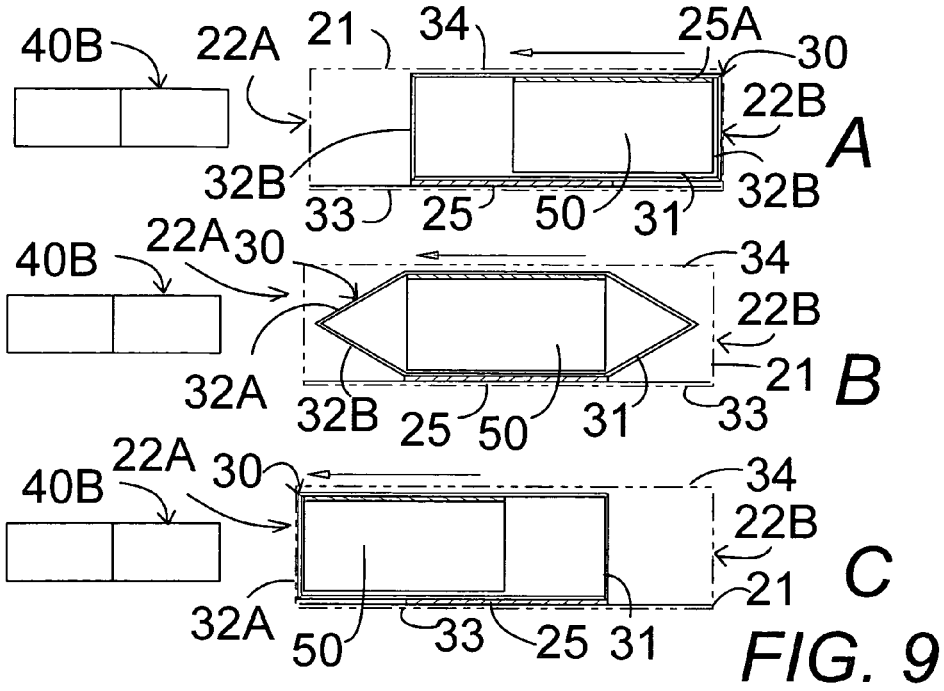
FIGS. 9A-9C are progressive schematic cross-sectional views taken through one of the chambers of a passive magnetic display unit of the present invention showing the display configuration having an iron bar sliding member moving toward an opening of the chamber switching the display face of the planar display loop in response to the magnet writing stylus in front of the opening to create a portion of the visual image.
Figure 10:
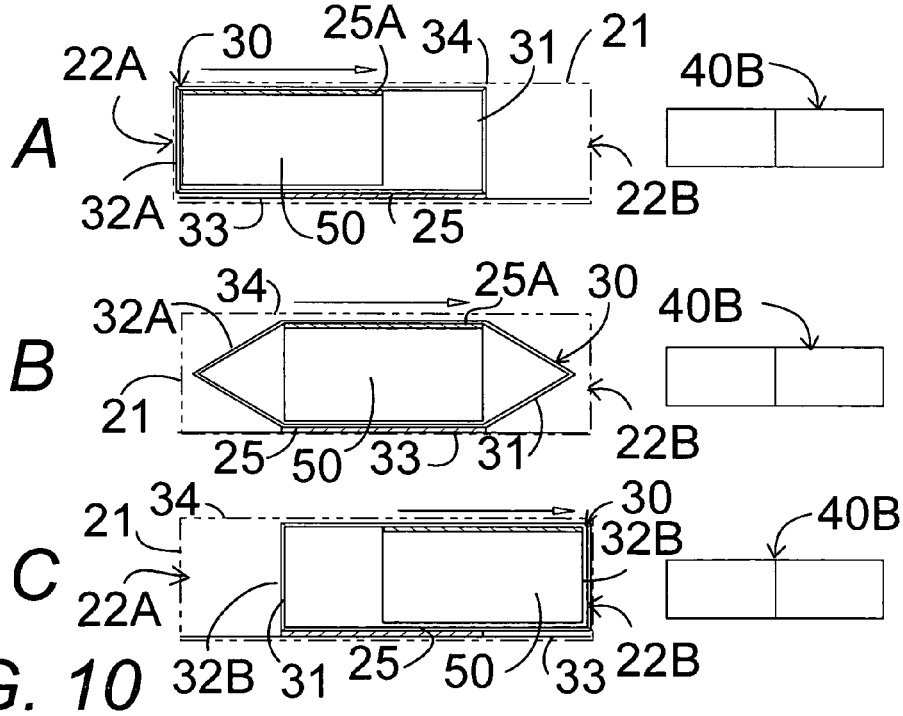
FIGS. 10A-10C are progressive schematic cross-sectional views taken through the chamber of the passive magnetic display unit of FIGS. 9A-9C, showing the display configuration having the iron bar sliding member moving away from the opening of the chamber switching the display face of the planar display loop in response to the magnet writing stylus held at a back of the display board to pull the sliding member away from the opening to erase the portion of the visual image.

The visual display board 20A and 20B comprises a configured array 20A, as in FIG. 1, or a grid array 20B, as in FIG. 2 of chambers 21. Each of the chambers 21 has an opening 22A and 22B, as shown in FIGS. 9 and 10, on one or both faces of the display board 20A and 20B, showing the front faces.

The magnetic stylus or elongated magnetic rod 40A and 40B has a least one magnetic end 41 and 42 smaller than the opening in each of the chambers 21. The magnetic rod 40A and 40B is moved by a user in front of the array of chambers to change the visual display.

At least one planar display loop 31 attaches within each of the chambers 21 adjacent to the opening 22A and 22B. The display material loop 31 comprises at least two adjacent visual display surfaces 32A and 32B connected together by a hinge means for allowing a first visual display surface 32A to pivot relative to a second visual display surface 32B. The visual display surfaces 32A and 32B each having a display face visually distinct from the display face of the other visual display surface which faces are alternately visible through the opening, as shown in FIGS. 1 and 2.

The second visual display surface 32B is attached to a first inside wall of the chamber by an attaching means 25 and a hinge means which allows the second visual display surface 32B to pivot relative to the first inside wall of the chamber and attaching means 25. The second visual display surface 32B is normally in a first position perpendicular to the first inside wall and visible through the opening in each of the chambers, as shown in FIGS. 3A, 4C, 8A, 9A, and 10C.

The sliding member 50 and 60 inside the chamber is attached to the first visual display surface 32A by a hinge pivot means for allowing the first visual display surface 32A to pivot relative to the sliding member 50 and 60, such as a hinged extension of the loop attached by an adhesive or other attaching means 25A. The sliding member 50 and 60 is movable within the chamber 21 to move toward and away from the opening 22A along a second interior wall 34 of the chamber parallel to and spaced apart from the first interior wall 33 having the attaching means 25. The sliding member 50 and 60 is normally positioned away from the opening so that the first visual display surface 32A is parallel to and adjacent to the second interior wall 34 and not visible through the opening as in FIGS. 3A, 4C, 8A, 9A, and 10C. The sliding member 50 and 60 comprising a magnetically attractive material so that the magnetic rod 40A and 40B passing in front of the chamber opening 22A magnetically attracts the sliding member 50 and 60 to move toward the opening thereby causing the first display surface 32A to pivot into perpendicular alignment to the first and second interior walls so that the first display surface 32A is visible through the opening, as shown in FIGS. 3C, 4A, 8C, 9C, and 10A. Simultaneously, this causes the second display surface 32B to pivot to be in parallel alignment with and adjacent to the first interior wall 33 so that the second visual display surface is not visible through the opening, thereby forming a visual display by creating a visual pattern of first display faces on the first display surfaces 32A visually distinct from the second display faces 32B caused by magnetic rod 40A and 40B passing in front of chosen openings 21 to create the desired visual pattern, as in FIGS. 1 and 2. Alternately, using the magnetic rod 40A and 40B to slide the sliding member away 50 and 60 from the opening 22A to move the second display faces of the second visual display surface 32B to be visible through the openings, thereby removing the visual pattern to erase the visual display, as shown in FIGS. 3A, 4C, 8A, 9A, and 10C. Therefore, the present invention provides a magnetically actuated visual display board device for using magnetic attraction to form and erase visual images.

In FIGS. 3A-3C, the sliding member 50 comprises a magnetic element having a sliding member positive pole and a sliding member negative pole, is indicated by the plus and minus, and the elongated magnetic rod comprises a magnetic element 40A having a magnetic rod positive pole 41 and a magnetic rod negative pole 42 so that when the sliding member 50 has a sliding member negative pole facing the opening, moving the magnetic rod positive pole in front of the opening slides the sliding member toward the opening, as in FIGS. 3A-3B, displaying the first display face of the first display surface 32A in the opening to create a portion of the visual display.

In FIGS. 4A-4C, moving the magnetic rod negative pole 42 in front of the opening, slides the sliding member 50 away from the opening, thereby displaying the second display face of the second display surface 32B in the opening to erase the portion of the visual display.

Reversing the orientation of the sliding member 50, wherein the sliding member 50 has a sliding member positive pole facing the opening, moving the magnetic rod 40A negative pole 42 in front of the opening slides the sliding member toward the opening displaying the first display face in the opening to create a portion of the visual display and moving the magnetic rod positive pole 41 in front of the opening slides the sliding member 50 away from the opening displaying the second display face in the opening to erase the portion of the visual display.

Figure 8:
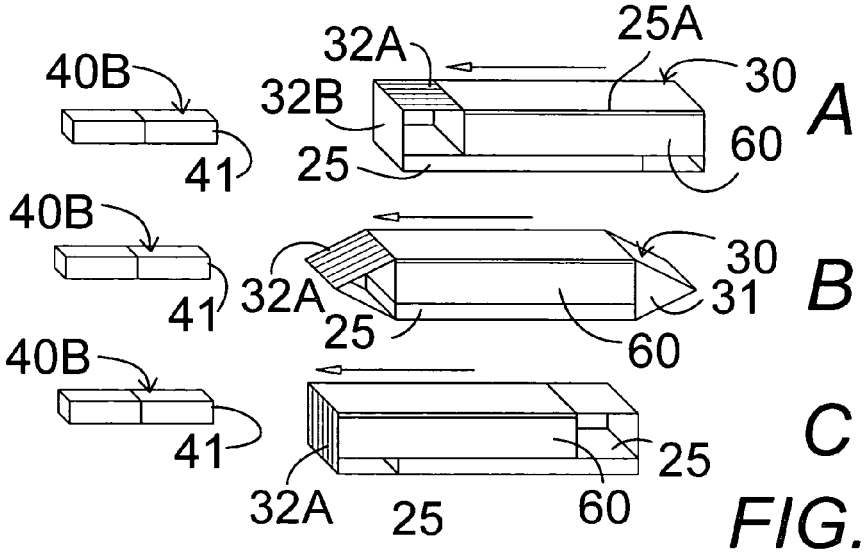
FIGS. 8A-8C are progressive schematic cross-sectional views of a passive magnetic display unit of the present invention showing the display configuration having an iron bar sliding member moving toward an opening of the chamber switching the display face of the planar display loop in response to the magnet writing stylus in front of the opening to create a portion of the visual image.

In FIGS. 5-10, the sliding member 60 comprises a non-polar element, such as an iron sliding member attracted by magnets and moving the magnetic rod 40B in front of the opening slides the sliding member 60 toward the opening displaying the first display face of the first display surface 32A in the opening to create a portion of the visual display, as in FIGS. 8C, 9C, and 10A, and moving the magnetic rod 40B in front of an opposite end of the chamber slides the sliding member 60 away from the opening displaying the second display face 32B in the opening to erase the portion of the visual display, as shown dynamically in FIGS. 10A-10C.

The magnetically actuated display board of the present invention may comprise a grid array of chambers, each of the chambers having an opening 22A and 22B on each of two faces of the display board, as shown in FIGS. 9A-9C and FIGS. 10A-10C wherein the loop 31 of planar display material within each of the chambers comprises two adjacent visual display surfaces 32A and 32B adjacent to each of the openings 22A and 22B on each of the two faces of the display board and each first display surface 32A is pivotally connected to one end of the sliding member 50 adjacent to the first end opening 22A and to the first interior wall 33 adjacent to the second end opening 22B, so that the sliding member in each chamber creates and erases a portion of a visual display on each face of the display board simultaneously.

Alternately, the writing display board may comprise a grid array of chambers, each of the chambers having a single opening on a single face of the display board and the at least one loop 31 of planar display material within each of the chambers comprises two adjacent visual display surfaces 32A and 32B adjacent to the single opening 22A in the single face of the display board.

The device of claim 6 wherein the at least one loop of planar display material within each of the chambers comprises a closed loop of planar material.

The loop of planar display material 21 within each of the chambers 21 may comprise a sheet of planar material, a portion of which is attached to the first inside wall 33 of the chamber 21 by an attaching means 25 which may be an adhesive or a planar holding member attached to the first interior wall 33 of the chamber, and another portion of which as attached to the sliding member 50 and 60 by an adhesive or other attaching means 25A, and the means for allowing the display surfaces 32A and 32B to pivot relative to each other and relative to the first interior wall 33 and the sliding member 50 and 60 may comprise a thin portion of the material creating a living hinge in the material.

The loop of planar display material 31 may comprise at least one of the planar display materials taken from the list of planar display materials comprising paper with paper hinges, paper board with paper board hinges, card board with bent cardboard hinges, plastic with living hinges, extruded plastic with living hinges, molded plastic with living hinges, compressed pulp with distressed pulp hinges, and synthetic planar material with living hinges.

In use, a magnetic rod 40A and 40B comprising an elongated magnetic writing stylus passes in front of any of an array of desired chambers 21 to pull the sliding elements 50 and 60 forward to make the first visual display surfaces 32B appear in the chamber openings 21 visually different from the second visual display surfaces 32B already visible in the other chambers, to create an array of similar visual display surfaces 32B to form alphanumeric characters, symbols, images, or any other desired visual array of a different color than the background. When the magnetic rod 40B or magnetic writing stylus passes in back of the chamber containing the iron sliding element 60 or the magnetic rod 40A or magnetic writing stylus is turned around to reverse the polarity, the magnetically polarized sliding element 50 is pulled or pushed backward, respectively, to erase the array and make all the squares match the background color.

The visual display board may be fabricated of any non-magnetically attractive and non-magnetic material, such as wood or a molded synthetic material.

It is understood that the preceding description is given merely by way of illustration and not in limitation of the invention and that various modifications may be made thereto without departing from the spirit of the invention as claimed.

What is claimed is:

1. A magnetically actuated visual display board device for using magnetic attraction to form and erase visual images, the device comprising:

a visual display board comprising a grid array of chambers, each of the chambers having an opening on at least one face of the display board;

an elongated magnetic rod having a least one magnetic end smaller than the opening in each of the chambers, the magnetic rod moved by a user in front of the array of chambers;

at least one loop of planar display material within each of the chambers adjacent to the opening, the at least one loop of display material comprising two adjacent visual display surfaces connected together by means for allowing a first visual display surface to pivot relative to a second visual display surface, the visual display surfaces each having a display face visually distinct from the display face of the other visual display surface, the display faces alternate visible through the opening; the second visual display surface attached to a first inside wall of the chamber by means for allowing the second visual display surface to pivot relative to the first inside wall of the chamber, the second visual display surface normally in a first position perpendicular to the first inside wall and visible through the opening in each of the chambers;

a sliding member inside the chamber attached to the first visual display surface by means for allowing the first visual display surface to pivot relative to the sliding member, the sliding member being movable within the chamber to move toward and away from the opening along a second interior wall of the chamber parallel to and spaced apart from the first interior wall, the sliding member normally positioned away from the opening so that the first visual display surface is parallel to and adjacent to the second interior wall 34 and not visible through the opening, the sliding member comprising a magnetically attractive material so that the magnetic rod passing in front of the chamber opening magnetically attracts the sliding member to move toward the opening thereby causing the first display surface to pivot into perpendicular alignment to the first and second interior walls so that the first display surface is visible through the opening and simultaneously causing the second display surface to pivot to be in parallel alignment with and adjacent to the first interior wall so that the second visual display surface is not visible through the opening, thereby forming a visual display by creating a visual pattern of first display faces on the first display surfaces visually distinct from the second display faces caused by magnetic rod passing in front of chosen openings to create the desired visual pattern; and alternately using the magnetic rod to slide the sliding member away from the opening to move the second display faces of the second visual display surface to be visible through the openings, thereby removing the visual pattern to erase the visual display; thereby forming a magnetically actuated visual display board device for using magnetic attraction to form and erase visual images.

2. The device of claim 1 wherein the sliding member comprises a magnetic element having a sliding member positive pole and a sliding member negative pole and the elongated magnetic rod comprises a magnetic element having a magnetic rod positive pole and a magnetic rod negative pole so that when the sliding member has a sliding member negative pole facing the opening moving the magnetic rod positive pole in front of the opening slides the sliding member toward the opening displaying the first display face in the opening to create a portion of the visual display and moving the magnetic rod negative pole in front of the opening slides the sliding member away from the opening displaying the second display face in the opening to erase the portion of the visual display.

3. The device of claim 1 wherein the sliding member comprises a magnetic element having a sliding member positive pole and a sliding member negative pole and the elongated magnetic rod comprises a magnetic element having a magnetic rod positive pole and a magnetic rod negative pole so that when the sliding member has a sliding member positive pole facing the opening moving the magnetic rod negative pole in front of the opening slides the sliding member toward the opening displaying the first display face in the opening to create a portion of the visual display and moving the magnetic rod positive pole in front of the opening slides the sliding member away from the opening displaying the second display face in the opening to erase the portion of the visual display.

4. The device of claim 1 wherein the sliding member comprises a non-polar element attracted by magnets and moving the magnetic rod in front of the opening slides the sliding member toward the opening displaying the first display face in the opening to create a portion of the visual display and moving the magnetic rod in front of an opposite end of the chamber slides the sliding member away from the opening displaying the second display face in the opening to erase the portion of the visual display.

5. The device of claim 1 wherein the writing display board comprises a grid array of chambers, each of the chambers having a single opening on a single face of the display board and the at least one loop of planar display material within each of the chambers comprises two adjacent visual display surfaces adjacent to the single opening in the single face of the display board.

6. The device of claim 1 wherein the writing display board comprises a grid array of chambers, each of the chambers having an opening on each of two faces of the display board and the at least one loop of planar display material within each of the chambers comprises two adjacent visual display surfaces adjacent to each of the openings on each of the two faces of the display board and the first display surface adjacent to a first end opening on the first face is pivotally connected to one end of the sliding member and the first display surface adjacent to the second end opening on the second face is attached to the first interior wall, so that the sliding member in each chamber creates and erases a portion of a visual display on each face of the display board simultaneously.

7. The device of claim 6 wherein the at least one loop of planar display material within each of the chambers comprises a closed loop of planar material.

8. The device of claim 1 wherein the at least one loop of planar display material within each of the chambers comprises a sheet of planar material a portion of which is attached to the first inside wall of the chamber and another portion of which as attached to the sliding member, wherein the means for allowing the display surfaces to pivot relative to each other and relative to the first interior wall and the sliding member comprises a thin portion of the material creating a living hinge in the material.

9. The device of claim 8 wherein the at least one loop of planar display material comprises planar compressed pulp material forming flat display surfaces.

10. The device of claim 9 wherein the at least one loop of planar display material comprises planar synthetic material forming flat display surfaces.

11. The device of claim 8 wherein the at least one loop of planar display material comprises at least one of the planar display materials taken from the list of planar display materials comprising paper with paper hinges, paper board with paper board hinges, card board with bent cardboard hinges, plastic with living hinges, extruded plastic with living hinges, molded plastic with living hinges, compressed pulp with distressed pulp hinges, and synthetic planar material with living hinges.

* * * * *